United States Patent [19]

Borrelli et al.

[11] 4,246,337

[45] Jan. 20, 1981

[54] PHOTOSENSITIVE MEDIUM FOR OPTICAL INFORMATION STORAGE

[75] Inventors: Nicholas F. Borrelli, Elmira; Peter L. Young, Painted Post, both of N.Y.

[73] Assignee: Corning Glass Works, Corning, N.Y.

[21] Appl. No.: 901,428

[22] Filed: May 1, 1978

[51] Int. Cl.[1] ..... G03C 1/76; G03C 1/02; G03C 1/28

[52] U.S. Cl. ..... 430/496; 430/502; 430/523; 430/599; 430/604; 430/605; 430/932

[58] Field of Search ..... 96/94 BF, 68, 107, 67, 96/108, 64, 90 PC; 350/354, 160 P; 430/496, 502, 523, 599, 604, 605, 932

[56] References Cited

U.S. PATENT DOCUMENTS

| | | | |
|---|---|---|---|
| T966,003 | 1/1978 | Maskasky | 96/94 BF |
| 2,304,900 | 12/1942 | Stasiw | 96/94 BF |
| 3,219,450 | 11/1965 | Goldberg | 96/94 BF |
| 3,219,452 | 11/1965 | Hartouni | 96/94 BF |
| 3,367,778 | 2/1968 | Berriman | 96/64 |
| 3,368,895 | 2/1968 | Matejec et al. | 96/94 BF |
| 3,512,869 | 5/1970 | Plumat et al. | 350/354 |
| 3,852,066 | 12/1974 | Levy | 96/94 BF |
| 3,875,321 | 4/1975 | Gliemeroth et al. | 96/90 PC |

OTHER PUBLICATIONS

Cameron, et al. "Photophysical Changes in Silver-Silver Chloride System," Journal of the Optical Society of America, vol. 24, pp. 316-330 (1934).

*Primary Examiner*—Won H. Louie, Jr.

*Attorney, Agent, or Firm*—Kees van der Sterre; Clinton S. Janes, Jr.

[57] ABSTRACT

A photosensitive medium for storing optical information relating to the intensity and polarization of incident light, consisting of an inorganic multilayer film comprising multiple thin layers of silver chloride to which additive coloration has been imparted by chemical means, is described.

19 Claims, 1 Drawing Figure

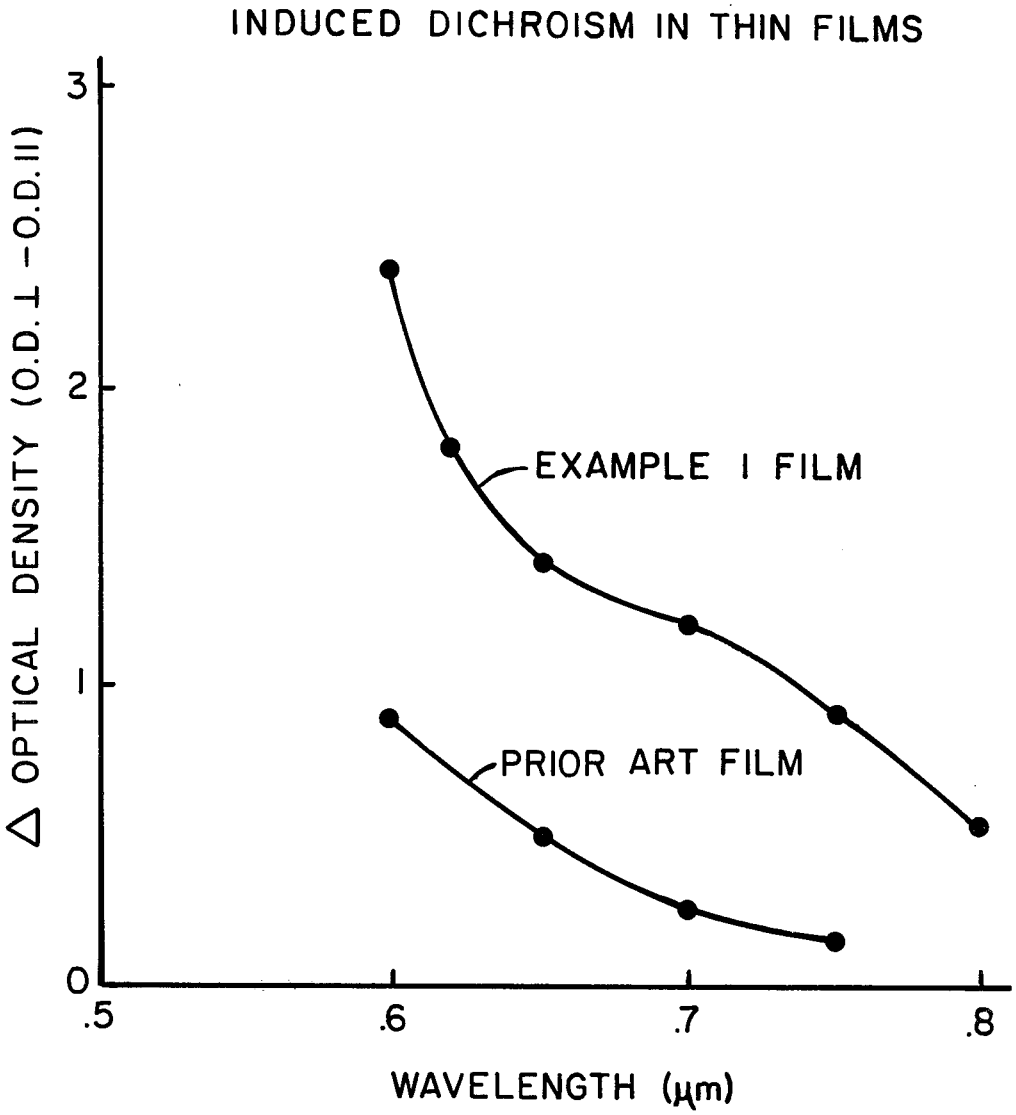
INDUCED DICHROISM IN THIN FILMS
Δ OPTICAL DENSITY (O.D.⊥ − O.D.∥)
3
2
1
0
.5
.6
.7
.8
WAVELENGTH (μm)
EXAMPLE I FILM
PRIOR ART FILM

PHOTOSENSITIVE MEDIUM FOR OPTICAL INFORMATION STORAGE

BACKGROUND OF THE INVENTION

Photosensitive films comprising silver halides have been a primary object of photographic research. Although the photolytic reduction of halides to provide the latent silver photographic image is of major interest, the reverse reaction through which metallic silver is reconverted to a silver halide by the action of light or heat has also been the subject of study.

An early discussion of the changes in absorption behavior produced in a darkened photographic plate by exposure to red light is provided by Cameron and Taylor in "Photophysical Changes in Silver-Silver Chloride Systems," *Journal of the Optical Society of America,* Vol. 24, pp. 316–330 (1934). These authors verified that optically or chemically darkened silver halide-containing emulsions can be selectively bleached, particularly with red light, such that they become more transparent to light of the bleaching wavelength. This behavior is referred to as color adaptation. It was further noted that polarized bleaching light produced a dichroic, birefringent image in the darkened film.

Recently, it was discovered that color adaptation, dichroism and birefringence could be optically induced in certain colored glasses containing silver halides by bleaching the glass with polarized light. As described by Araujo et al. in a copending, commonly assigned patent application, Ser. No. 739,205, filed Nov. 5, 1976, glass containing an additively colored silver halide phase, when irradiated with polarized light, typically becomes selectively bleached in a manner providing increased transparency with respect to light of the same polarization and color as the bleaching light. Thus the glass exhibits dichroism, birefringence and color adaptation which depend on the color and direction of polarization of the light used to bleach the glass, and information concerning this light can be deduced by examining the glass, as long as the bleached image persists.

As used in the prior art and in the present description, the term "additive coloration" refers to coloration caused by the presence of light-absorbing metal particles in a halide crystal of the same metal. Thus additively colored silver chloride is silver chloride wherein metallic silver particles are present in or on the silver chloride crystals.

Optically-induced dichroism has also been observed in silver-containing polycrystalline silver halide layers produced by evaporation techniques. Dichroism induced by bleaching silver halide films containing additions of vacuum-evaporated silver was reported by V. P. Cherkashin in *Soviet Physics-Solid State,* Vol. 13, No. 1, pp. 264–265 (1971). In the Russian journal *Opt. Spektrosk,* Vol. 40, pp. 1024–1029 (June 1976), L. A. Ageev et al. describe dichroic effects which were observed in silver/silver halide films produced by depositing a thin granular layer of silver on a glass substrate and then converting part of the silver to silver iodide by treatment in an iodine atmosphere.

In our copending patent application, Ser. No. 739,121, filed Nov. 5, 1976 and commonly assigned herewith, we describe multilayer photosensitive films comprising discrete metal island layers disposed between layers composed of a clear dielectric acceptor material such as AgCl, $PbI_2$ or the like. These films are light-absorbing films which can be bleached with visible light, and are useful for storing information relating to the intensity, polarization and, particularly, the color of bleaching light.

Silver halide layers also comprise important elements of many photochromic films, which are films intended to be transparent in the inactivated state but reversibly darkenable to a light-absorbing state by the action of incident light. Photochromic films of various configurations have been described by Brewer et al. in French Pat. No. 2,236,196, by Gliemeroth et al. in U.S. Pat. No. 3,875,321, by Plumat et al. in U.S. Pat. No. 3,512,869, and by Perveyev et al. in the *Soviet Journal of Optical Technology,* February, 1972, pp. 117–118.

In photochromic films, the feature which is desired is that of rapid and complete thermal fading of the darkened film to a generally clear state after irradiation with activating light is terminated. In contrast, photosensitive films intended for optical information storage should resist thermal fading so that variations in optical behavior (e.g., optical density) induced by irradiating the films will be relatively permanent.

For the optical storage of information in digital form, a thin optical recording medium which is optically alterable to a highly dichroic and birefringent state is desired. Although some of the known photosensitive glasses and silver halide photographic emulsions can provide relatively strong birefringence and dichroism, they are generally thicker than would be desired for efficient information storage. A focused laser beam is the best source for recording optical information in compact digital form, permitting spot sizes on the order of 1 micron or less. When films substantially thicker than about 2 microns are used, losses in spot resolution significantly limit the density of information storage.

While thin photosensitive films do not impose such limitations on resolution, the levels of dichroism and birefringence which have been observed such thin films produced in the prior art are somewhat limited. High levels of dichroism and birefringence are advantageous for information retrieval from such films because image contrast may be enhanced by viewing in transmitted light between crossed polarizers.

It is therefore a principal object of the present invention to provide photosensitive films for the optical storage of information which are limited in thickness and yet alterable to a highly dichroic and birefringent state by irradiation with linearly polarized light.

It is a further object of the invention to provide methods for producing photosensitive films with improved optical information storage behavior.

Further objects and advantages of the invention will become apparent from the following description thereof.

SUMMARY OF THE INVENTION

In silver halide photosensitive media of the type responsive to optical bleaching, both the size and size distribution of bleachable silver particles are thought to be important variables governing information storage capability. We associate high resolution with the presence of many small silver halide particles, while photolytically induced dichroism, birefringence and coloration are thought to require a relatively broad distribution of particle sizes and particle shapes. It is thought that the method of forming a photosensitive medium comprising additively colored silver halide phases critically affects the nature of the phases produced, and thus the levels of dichroism and birefringence which may be induced therein.

In accordance with the present invention, chemical agents are used to impart additive coloration to a polycrystalline silver halide layer by the partial reduction of some of the silver halide present therein to metallic silver. Very thin silver halide layers are used to limit the size of the silver halide particles produced, and multiple layers are used to provide a film exhibiting the optical density necessary for good contrast, and to obtain a full distribution of particle sizes and shapes in the film.

In one aspect, the invention includes a process for producing a photosensitive optical information storage medium which comprises the steps of (a) depositing a thin polycrystalline silver halide layer on a suitable substrate and (b) introducing one or more chemical agents into the layer to impart additive coloration thereto by partial reduction of some of the silver halide therein to silver metal. These steps are repeated until a multilayer film having a thickness not exceeding about 2 microns is provided. The film includes at least about 3 silver halide layers, and preferably more, depending upon the optical density and levels of induced dichroism and birefringence which are desired in the completed film.

The invention further includes a photosensitive optical information storage medium, capable of storing information relating to the intensity and polarization of incident light, which consists of an inorganic multilayer film having a total thickness not exceeding about 2 microns and comprising at least 3 polycrystalline photosensitive layers containing additively colored silver halide crystals. Each of the photosensitive layers is produced by depositing a polycrystalline silver halide layer on a suitable substrate, and introducing one or more chemical agents into the silver halide layer to impart additive coloration thereto by the partial reduction of some of the silver halide therein to silver metal.

The sequence of silver halide layer deposition and chemical agent introduction will depend on the particular agent selected for use in the film system. In some cases the agent may be a metallic reducing agent which is conveniently introduced during the formation of the silver halide layer by codeposition therewith. In other cases metal oxide agents may be used, and introduction is typically accomplished by depositing the oxide onto a previously deposited silver halide layer.

The thickness of the deposited silver halide layers is desirably maintained quite low, preferably in the range of about 100–1000 Å. In cases where metal oxides are deposited over the silver halide layers, the resulting metal oxide layers may also be quite thin, e.g., in the range of about 7–1000 Å. Through the use of these thin layers, photosensitive films comprising 80 or more additively colored silver halide layers, having a total thickness below 2 microns and exhibiting strong dichroism and birefringence, may be provided.

BRIEF DESCRIPTION OF THE DRAWING

The invention may be further understood by reference to the drawing which shows levels of induced dichroism induced in a photosensitive film provided in accordance with the invention, and in a prior art film, both as a function of the wavelength of transmitted light.

DETAILED DESCRIPTION

The preferred silver halide for manufacturing photosensitive media in accordance with the invention is silver chloride. Suitably thin layers of polycrystalline silver chloride may be obtained by the vacuum evaporation of silver chloride onto a suitable substrate, which may be a chemically inert substrate or a previously deposited silver chloride layer. The preferred starting substrate for information storage applications is a transparent ceramic substrate such as glass.

Vacuum evaporation is a preferred method of silver chloride layer deposition because it permits close control of film thickness and thus the particle size of the silver chloride crystals. Electron micrographs show a direct relationship between film thickness and silver chloride crystal size, particularly in the film thickness range of about 100–350 Å where very small (500 Å) crystals have been observed. Also, film discontinuities begin to appear in this thickness range, which discontinuities substantially increase the range of crystal sizes and shapes produced. Since such a microstructure facilitates the storage of optical information, films comprising many thin (100–350 Å) silver chloride layers are ordinarily preferred to films comprising a few thicker (>500 Å) layers.

A number of different methods may be used, either alone or in combination, to partially reduce crystalline silver chloride layers in order to develop additively coloring silver metal particles therein. Such methods include the application of an oxygen-deficient metal oxide to a previously deposited silver chloride layer, the introduction of metallic reducing agents into the silver chloride as dopants during layer deposition, the introduction of an immobile hole-trapping dopant into the silver chloride layer during deposition, or the application of a hole-trapping metal oxide over a previously deposited silver chloride layer.

Depending upon the method used to impart additive coloration to the silver chloride layers, the number of such layers is adjusted in order to provide the optical density required for good optical information storage characteristics. Films comprising as few as 3 silver chloride layers and up to 80 or more such layers have been prepared which exhibit excellent optical bleaching performance.

An example of an oxygen-deficient metal oxide which induces additive coloration in a previously deposited layer of silver chloride when applied thereto is silicon monoxide (SiO). This oxide is suitably deposited by vacuum evaporation in a manner similar to silver chloride, and may contain minor varying amounts of $SiO_2$ depending upon the conditions under which deposition is accomplished. It is thought that this oxide provides a reducing environment at the SiO/AgCl interface which results in the partial reduction of silver chloride to silver.

In depositing SiO by vaccum evaporation, it is found that best results are obtained if the oxygen deficiency of the SiO layer is limited. This may be accomplished by controlling the partial pressure of oxygen in the evaporation chamber during deposition. Best results are obtained at oxygen partial pressures on the order of $10^{-5}$ to $10^{-4}$ torr; at a vacuum of below $10^{-6}$ torr, the dichroic response of the film is somewhat reduced.

The thickness of the SiO-containing layer is not critical. Photosensitive films comprising SiO-containing layers exhibiting excellent photosensitive response typically comprise 25–30 silver chloride layers, each about 100–150 Å thick, and a similar number of SiO-containing layers, each about 250–500 Å thick.

The introduction of metallic reducing agents into the silver chloride layer as dopants for the purpose of imparting additive coloration thereto may be accomplished by codepositing the reducing agent onto the substrate along with the silver chloride. Metals which can be used for this purpose are those which reduce or aid in the reduction of silver chloride, and also have low melting temperatures. Examples of such metals are Au, Pb, Cu and In; however the preferred reducing agent for this purpose is Au.

The product of the codeposition of silver chloride with a metal dopant such as Au is a polycrystalline layer containing the dopant which exhibits additive coloration as deposited on the substrate. In many cases, however, further enhancement of the additive coloration may be desired. For this purpose it is possible to deposit other chemical agents, such as SiO or other metal oxides, on top of the doped silver chloride layer to promote further silver chloride reduction. Thus a combination of metal dopants and oxide layers may be used to provide the film properties desired.

Another method for imparting additive coloration to the silver chloride layer concurrently with layer deposition involves codepositing the silver chloride with a doping compound which can form hole traps in the deposited silver chloride layer. Such traps should be immobile, i.e., remain at fixed sites in the layer, and they should be thermally stable, i.e., able to retain hole trapping characteristics at the anticipated use temperatures of the film, so that the film will resist thermal fading.

Examples of compounds which can be used with silver chloride to provide such traps are $Ag_2S$ and $Ag_2Se$. These compounds form stable trapping sites in the film, thereby insuring the presence of elemental silver particles therein. Again, oxygen-deficient metal oxides or hole-trapping metal oxides can be used as supplemental reducing agents in combination with these doping compounds to intensify additive coloration, if desired.

A particularly efficient way to impart additive coloration to the silver chloride layers is to apply to each layer after deposition a layer of a hole-trapping metal oxide which aids in the formation or retention of metallic silver in the silver chloride layers. The use of such oxides is advantageous because it can provide increased optical density in the silver chloride layers, and/or permit the use of supplemental thermal or optical treatments to enhance optical density, so that fewer silver chloride layers are required to obtain an optically dense film.

Examples of hole-trapping metal oxides which are particularly effective in inducing additive coloration in a silver chloride layer as they are deposited thereon are PbO and $Cu_2O$. A hole-trapping metal oxide which can preserve optically or thermally enhanced additive coloration in a silver chloride layer is $SnO_2$.

Using $SnO_2$ as the sole agent to promote additive coloration in a silver chloride layer, partial reduction of the silver chloride is accomplished by the steps of depositing an $SnO_2$ layer over the silver chloride and then either heating the silver chloride and $SnO_2$ layers or irradiating them with ultraviolet light. On the other hand, when PbO or $Cu_2O$ are used to promote additive coloration in the silver chloride layers, additive coloration of each silver chloride layer occurs simultaneously with the deposition of PbO or $Cu_2O$ thereon, and supplemental treatments to enhance additive coloration are ordinarily not required.

As previously noted, the optical density of a photosensitive film comprising multiple layers comprising one or more of the hole-trapping oxides is typically higher than that of a film comprising an equivalent number of silver chloride layers wherein other agents are used to impart additive coloration. It is normally preferred that a photosensitive film to be used for optical information storage have an optical density of at least about 0.4 prior to bleaching, in order to provide suitable contrast in the bleached image. This density has been achieved with as few as three silver chloride layers when hole-trapping metal oxide agents are used, whereas 10–20 such layers may be used to achieve good optical density and response to polarized light in other film systems.

The photosensitive medium of the invention can be used for recording optical information using any of the prior art techniques by which such information has been imprinted on photosensitive media by bleaching. The wavelength range of good bleaching sensitivity for recording purposes in these films is typically about 0.5–0.7 microns, while the preferred wavelength range for reading information stored in the film is about 0.85–1.0 microns. Of course, stored information can also be read utilizing visible light, but such practice tends to somewhat degrade the stored image. Otherwise, the time period over which information may be usefully stored in these films is essentially indefinite, provided the films are shielded from bleaching light.

It may be desirable for some applications to extend the bleaching sensitivity range of the film to wavelengths below about 0.5 microns, to permit recording at shorter light wavelengths. The sensitivity of these films may be extended below the normal range by introducing a CuCl dopant into the silver chloride layers. This may be accomplished, for example, by vacuum-evaporating a mixture consisting of silver chloride containing a small amount of CuCl onto the substrate to form a CuCl-doped silver chloride layer.

The invention may be further understood by reference to the following detailed examples illustrating the preparation of photosensitive optical information storage media in accordance therewith.

EXAMPLE 1

A substrate consisting of a glass slide composed of a soda-lime-silica glass is selected for use as a film substrate. The slide is thoroughly cleaned and then positioned in a vacuum evaporation chamber above two tungsten evaporation boats, one containing a small quantity of silver chloride and the other containing a small quantity of PbO.

The vacuum chamber is evacuated to a pressure of about $10^{-4}$ torr and the tungsten boat containing silver chloride is electrically heated to vaporize some of the silver chloride therein. Heating is continued for a time sufficient to form a silver chloride layer about 300 Å in thickness on the surface of the glass slide.

After the silver chloride layer has been formed, the second tungsten boat containing PbO is electrically heated to cause vaporization of the oxide, with heating being continued until a layer approximately 20 Å in thickness has been provided on the silver chloride layer.

The above-described steps of silver chloride layer deposition and PbO layer deposition are repeated until a multilayer film comprising 40 silver chloride layers separated by 39 PbO layers is provided on the surface of the glass slide. The slide and film are then removed from the vacuum chamber and examined.

The film which has been deposited on the slide by this process exhibits rather broad absorption of visible light, being blue in color and exhibiting a light transmittance at about 0.6 microns of about 0.12.

A spot on this film is bleached with polarized red light (647 Å) from an 80 mW krypton laser at an incident power level of 0.208 watts/cm$^2$ for a bleaching interval of 2 minutes. The bleached spot is then examined for dichroism over the wavelength range from about 0.6–0.85 μm by measuring the optical density of the bleached spot with respect to light linearly polarized in a direction parallel to the direction of polarization of the red bleaching light (O.D.11) and light polarized perpendicularly thereto (O.D.⊥). The dichroic ratio of the bleached spot (R) and the difference in parallel and perpendicular optical densities (ΔO.D.) are then computed.

The results of this series of measurements are reported in Table I below. Included in the Table are the parallel and perpendicular optical densities at four measuring wavelengths, and the dichroic ratios and optical density differences computed therefrom.

TABLE I

| Measuring Wavelength (μm) | O.D. ⊥ | O.D. 11 | Dichroic Ratio (R) | ΔO.D. |
|---|---|---|---|---|
| 0.85 | 0.8 | 0.5 | 1.6 | 0.3 |
| 0.80 | 1.1 | 0.55 | 2.2 | 0.55 |
| 0.70 | 1.9 | 0.7 | 2.43 | 1.2 |
| 0.60 | 3.8 | 1.4 | 2.71 | 2.4 |

The birefringence of the bleached spot at 0.85 μm, expressed as the difference between the refractive index measured for light polarized in a direction parallel to the direction of polarization of the bleaching light and light polarized perpendicularly thereto, is about 0.099.

The results set forth in Table I above are compared with analogous data obtained from an examination of a prior art film in the appended DRAWING. The prior art film was a multi layer film comprising 10 metallic silver layers and 11 silver chloride layers, produced by alternately depositing silver island layers having an effective thickness of about 35 Å and silver chloride layers having an effective thickness of about 400 Å on a glass substrate. The film was selectively bleached using linearly polarized laser light of 6328 Å wavelength from a He-Ne laser operating at an incident power level of 0.040 watts/cm$^2$ for an exposure interval of 20 minutes.

The substantial differences between the levels of induced dichroism in the two cases demonstrate the importance of film fabrication procedure and film structure on the optical properties of the resulting films. Because of the high levels of induced dichroism exhibited thereby, films such as described in Example 1 above, containing PbO as the chemical agent for imparting additive coloration to the silver chloride layers, constitute preferred embodiments of the present invention.

EXAMPLE 2

A substrate consisting of a glass slide composed of a soda-lime-silica glass is selected for use as a film substrate. This slide is thoroughly cleaned and then positioned in a vacuum evaporation chamber above two tungsten evaporation boats, one containing a small quantity of silver chloride, the other containing a small quantity of SiO.

The vacuum chamber is evacuated to a pressure of about $10^{-6}$ torr and some of the silver chloride in the first tungsten boat is vaporized by electrical resistance heating, whereupon a discontinuous silver chloride layer having an effective thickness of about 150 Å is formed on the exposed surface of the glass slide.

The second tungsten boat and contents are then electrically heated to cause evaporation of the SiO, with heating being continued until a SiO-containing layer approximately 300 Å in thickness, is deposited on the silver chloride layer.

The above-described steps of silver chloride layer deposition and SiO layer deposition are repeated until a photosensitive film comprising 40 silver chloride layers and the same number of SiO-containing layers is deposited on the glass slide. The slide is then removed from the vacuum chamber and examined. The photosensitive film which has been formed on the slide by the described procedure exhibits rather broad absorption of visible light, being brown in color and having an unbleached transmittance of about 0.30 at a light wavelength of about 0.6 microns.

A spot on this film is optically bleached by exposure to linearly polarized green laser light from a krypton laser (principal wavelength of 0.55 microns) for an exposure interval of 120 seconds at an incident intensity of 0.5 watts/cm$^2$. The bleached spot exhibits a color which is somewhat shifted toward the green, and is both dichroic and birefringent. The optical transmittance of the spot with respect to light polarized in a direction parallel to the direction of polarization of the green bleaching light is about 0.34 at 0.6 microns, whereas the 0.6 micron transmittance perpendicular to that direction is about 0.10. The dichroic ratio of the bleached spot is thus about 2.13.

EXAMPLE 3

A quantity of Au-doped silver chloride is prepared by fusing a mixture consisting of 4 grams of silver chloride and one gram of metallic gold powder at 550° C. A small piece of the fusion product is placed in an electrically heated tungsten evaporation boat in a vacuum chamber and a clear glass slide is positioned over the boat. The chamber is then evacuated to a pressure of $10^{-6}$ torr and the boat is heated to vaporize the contents. A discontinuous layer of Au-doped silver chloride, having an effective thickness of about 130 Å, is thereby formed on the exposed surface of the glass slide.

A metal oxide layer comprising SiO and having a thickness of about 350 Å is then deposited over the Au/AgCl layer by vacuum evaporation using the procedure described in Example 2, except that the partial pressure of oxygen in the vacuum chamber during SiO deposition is about $10^{-3}$ torr. The steps of Au/AgCl layer deposition and SiO layer deposition are then repeated until a film comprising 31 Au/AgCl layers and an equivalent number of SiO-containing layers is provided on the glass slide.

The slide is then removed from the vacuum chamber and the photosensitive film thereon is examined. The film again exhibits rather broad absorption of visible light, being brown in color and having an unbleached transmittance of about 0.14 at 0.57 microns.

A spot on this film is then optically bleached by exposure to linearly polarized green light from a krypton laser as in Example 2. After a 60-second exposure to the laser at an incident light intensity of about 0.5 watts/cm$^2$, the bleached spot exhibits, at a light wavelength of 0.57 microns, a light transmittance of about 0.31 parallel to the direction of polarization of the bleaching light and about 0.12 perpendicular to that direction. The dichroic ratio of the bleached spot is thus about 1.81. Images with very good contrast and resolution can be recorded on this film, with optical resolution estimated to be in the 1000 lines/mm range.

EXAMPLE 4

A quantity of $Ag_2S$-doped silver chloride is provided by mixing 1 gram of silver chloride with 0.12 grams of $Ag_2S$ and fusing this mixture in a glass container at atmospheric pressure. A piece of this fusion product is placed in a tungsten evaporation boat in a vacuum chamber and a clean glass slide is positioned over the boat.

The vacuum chamber is then evacuated to a pressure of $10^{-6}$ torr and the tungsten boat is heated to vaporize the $Ag_2S$-AgCl mixture. A layer of AgS-doped silver chloride about 150 Å thick is thereby formed on the surface of the glass slide.

A metal oxide layer containing SiO, having a thickness of about 300 Å, is then deposited over the silver chloride layer by vacuum evaporation in accordance with the procedure described in Example 2, except that the partial pressure of oxygen in the vacuum chamber during deposition is about $7\times10^{-4}$ torr. The described sequence of doped silver chloride layer and SiO-containing layer deposition is then repeated until a film comprising 25 silver chloride layers and the same number of SiO-containing layers is provided on the glass surface.

The glass slide is then removed from the vacuum chamber and examined. The deposited film is found to exhibit rather broad absorption of visible light, being brown in color and having a light transmittance of about 0.35 at a wavelength of 0.60 microns.

A spot on this film is then optically bleached with polarized green laser light from a krypton laser as in Example 2. After a 120-second exposure at an incident power level of about 0.5 watts/cm$^2$, the bleached spot exhibits a light transmittance at 0.6 microns of about 0.38 for light polarized parallel to the direction of polarization of the bleaching light, and 0.17 for light polarized perpendicularly thereto. The dichroic ratio of the bleached spot is thus about 1.83 at this wavelength. This film also exhibits image resolution in the range of about 1000 lines/mm and thus can store images with excellent contrast and resolution.

EXAMPLE 5

A clear glass slide is positioned in a vacuum evaporation chamber over two tungsten evaporation boats, one containing a quantity of silver chloride and the other, $SnO_2$. The chamber is then evacuated to a pressure of $10^{-6}$ torr and the first evaporation boat is heated to vaporize the silver chloride, forming a silver chloride layer about 200 Å thick on the surface of the glass slide. The second evaporation boat, containing $SnO_2$, is then heated to vaporize the oxide until a layer about 300 Å thick is formed on the silver chloride layer.

This sequence of silver chloride layer deposition and SnO layer deposition is repeated until a film comprising 6 silver chloride layers and the same number of $SnO_2$ layers is provided on the surface of the glass slide. The slide is then removed from the vacuum chamber and examined. The film on the surface of the slide is found to be quite transparent, with a visible transmittance of over 0.50 in the visible range.

Additive coloration is imparted to the silver chloride layers of this film by heating. The glass slide and supported film are placed in an oven operating at 200° C. for a few seconds, after which the film is found to exhibit broad absorption of visible light, with a light transmittance at 0.60 microns of about 0.15.

A spot on this film is bleached with linearly polarized red laser light (principal wavelength of 6329 Å) at an incident power level of about 2 milliwatts/cm$^2$ for a bleaching interval of 1 hour. The bleached spot is then examined for dichroism and birefringence as in Example I.

The results of this examination are set forth in Table II below, which reports the optical density of the bleached spot at five wavelengths with respect to light polarized parallel to the direction of polarization of the optical bleaching light (O.D.11) and light polarized perpendicularly thereto (O.D.⊥). The dichroic ratio (R) and difference in optical densities ΔO.D. computed from these optical density values are also reported.

TABLE II

| Measuring Wavelength (μm) | O.D. ⊥ | O.D. 11 | Dichroic Ratio (R) | ΔO.D. |
|---|---|---|---|---|
| 0.75 | 0.68 | 0.63 | 1.08 | 0.05 |
| 0.70 | 0.72 | 0.57 | 1.26 | 0.15 |
| 0.65 | 0.76 | 0.42 | 1.81 | 0.34 |
| 0.60 | 0.80 | 0.60 | 1.33 | 0.20 |
| 0.55 | 0.81 | 0.87 | 0.93 | −0.06 |

The birefringence of the bleached spot, computed as the refractive index difference as in Example 1, was 0.012 at a wavelength of 0.75 μm. Again the photosensitive film produced as described provides a suitable medium for recording microimages with high resolution and high contrast. Essentially equivalent results are provided in this film system by inducing additive coloration in the silver chloride layers using ultraviolet light rather than heat.

Of course, the foregoing examples are merely illustrative of photosensitive films and methods for their production which may be resorted to by those skilled in the art for the purpose of recording optical information in accordance with the present invention. It will be evident that numerous variations and modifications in the film structures and methods hereinabove described may be used to achieve the objectives of the invention within the scope of the appended claims.

We claim:

1. A photosensitive optical information storage medium for storing optical information relating to the intensity and polarization of incident light which consists of an inorganic multilayer film having a total thickness not exceeding 2 microns and comprising at least 3 polycrystalline photosensitive layers containing additively colored silver halide crystals, each of said layers being produced by:

(a) depositing a polycrystalline silver halide layer on a suitable substrate; and (b) introducing one or more inorganic chemical agents into the silver halide layer in an amount effective to impart additive coloration thereto by the partial reduction of some of the silver halide in the layer to metallic silver, said inorganic chemical agents being selected from the group consisting of:
(i) oxygen-deficient metal oxides;
(ii) metallic reducing agents;
(iii) immobile hole-trapping dopants; and
(iv) hole-trapping metal oxides.

2. A photosensitive optical information storage medium in accordance with claim 1 wherein the polycrystalline silver halide layer is composed of silver chloride.

3. A photosensitive optical information storage medium in accordance with claim 2 wherein the polycrystalline silver chloride layer comprises a CuCl dopant.

4. A photosensitive optical information storage medium in accordance with claim 2 wherein the chemical agents which impart additive coloration to the silver chloride layer include a layer of SiO deposited onto said silver chloride layer.

5. A photosensitive optical information storage medium in accordance with claim 2 wherein the chemical agents which impart additive coloration to the silver chloride layer include at least one metallic dopant selected from the group consisting of Au, Cu, Pb and In, which dopant is codeposited with the silver chloride onto said substrate.

6. A photosensitive optical information storage medium in accordance with claim 5 wherein the metallic dopant is Au.

7. A photosensitive optical information storage medium in accordance with claim 2 wherein the chemical agents which impart additive coloration to the silver chloride layer include at least one immobile hole-trapping dopant selected from the group consisting of $Ag_2S$ and $Ag_2Se$, said dopant being codeposited with the silver chloride on said substrate.

8. A photosensitive optical information storage medium in accordance with claim 2 wherein the chemical agents which impart additive coloration to the silver chloride layer include a layer of at least one hole-trapping metal oxide selected from the group consisting of PbO, $Cu_2O$ and $SnO_2$ deposited as a layer over said silver chloride layer.

9. A photosensitive optical information storage medium in accordance with claim 8 wherein the hole-trapping metal oxide is PbO.

10. A process for producing a photosensitive optical information storage medium for storing optical information relating to the intensity and polarization of incident light which comprises the steps of:

(a) depositing a polycrystalline silver halide layer on a chemically inert substrate;

(b) introducing one or more inorganic chemical agents into the layer to impart additive coloration thereto by the partial reduction of some of the silver halide therein to silver metal, said inorganic chemical agents being selected from the group consisting of:
(i) oxygen-deficient metal oxides;
(ii) metallic reducing agents;
(iii) immobile hole-trapping dopants; and
(iv) hole-trapping metal oxides; and (c) repeating steps (a) and (b) until a multilayer film having a total thickness not exceeding 2 microns, comprising at least 3 silver halide layers exhibiting additive coloration, is provided on the substrate.

11. A process in accordance with claim 10 wherein the chemically inert substrate consists of transparent glass.

12. A process in accordance with claim 11 wherein the polycrystalline silver halide layer is deposited on the substrate by vacuum-evaporating a layer of polycrystalline silver chloride thereon.

13. A process in accordance with claim 12 wherein the step of introducing one or more chemical agents into the polycrystalline silver chloride layer comprises depositing a layer of SiO thereon.

14. A process in accordance with claim 13 wherein the SiO is deposited upon the silver chloride layer by vacuum evaporation at an oxygen partial pressure of $10^{-5}$–$10^{-4}$ torr.

15. A process in accordance with claim 12 wherein the step of introducing one or more chemical agents into the polycrystalline silver chloride layer comprises codepositing with the silver chloride a metallic reducing agent selected from the group consisting of Au, Cu, Pb and In.

16. A process in accordance with claim 15 wherein the metallic reducing agent is Au.

17. A process in accordance with claim 12 wherein the step of introducing one or more chemical agents into the polycrystalline silver chloride layer comprises codepositing with the silver chloride an immobile hole-trapping dopant selected from the group consisting of $Ag_2S$ and $Ag_2Se$.

18. A process in accordance with claim 12 wherein the step of introducing one or more chemical agents into the polycrystalline silver chloride layer comprises depositing a layer of a hole-trapping metal oxide selected from the group consisting of PbO, $Cu_2O$ and $SnO_2$ thereon.

19. A process in accordance with claim 18 wherein the hole-trapping metal oxide is PbO.

* * * * *